US010455675B2

(12) United States Patent
Retterath et al.

(10) Patent No.: US 10,455,675 B2
(45) Date of Patent: Oct. 22, 2019

(54) ARTICLES FOR ELIMINATING STATIC ELECTRICITY AND METHODS FOR THEIR USE

(71) Applicant: 3M INNOVATIVE PROPERTIES COMPANY, St. Paul, MN (US)

(72) Inventors: Joshua M. Retterath, Cannon Falls, MN (US); Bruce E. Tait, Woodbury, MN (US); Chris J. Tanley, Stillwater, MN (US); Fred J. Roska, Woodbury, MN (US); Terence A. Lee, Decatur, AL (US); Kevin B. Newhouse, Houlton, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 355 days.

(21) Appl. No.: 15/106,595

(22) PCT Filed: Dec. 18, 2014

(86) PCT No.: PCT/US2014/071096
§ 371 (c)(1),
(2) Date: Jun. 20, 2016

(87) PCT Pub. No.: WO2015/095490
PCT Pub. Date: Jun. 25, 2015

(65) Prior Publication Data

US 2017/0150588 A1 May 25, 2017

Related U.S. Application Data

(60) Provisional application No. 61/919,291, filed on Dec. 20, 2013.

(51) Int. Cl.
*H05F 3/02* (2006.01)
*B65H 27/00* (2006.01)

(52) U.S. Cl.
CPC ..... *H05F 3/02* (2013.01); *B65H 27/00* (2013.01); *B65H 2301/5133* (2013.01);
(Continued)

(58) Field of Classification Search
CPC ..... A61N 1/14; B65G 15/34; B65G 21/2027; B65G 21/2036; B65H 18/28; B65H 20/02;
(Continued)

(56) References Cited

U.S. PATENT DOCUMENTS 3,582,444 A 6/1971 Ngo et al.
3,671,806 A * 6/1972 Whitmore ..... B65H 29/125 361/212
(Continued)

FOREIGN PATENT DOCUMENTS

CN 202131433 2/2012
CN 104870345 A 8/2015
(Continued)

OTHER PUBLICATIONS

Annex to the European Search Report on European Patent Application No. EP 14872213, date of completion of the search Oct. 31, 2017, 6 pages.
(Continued)

*Primary Examiner* — Thienvu V Tran
*Assistant Examiner* — Nicolas Bellido
(74) *Attorney, Agent, or Firm* — Eloise J. Maki; Gregory D. Allen; Melanie G. Gover

(57) ABSTRACT

A looped pile static reduction blanket or cloth, an apparatus including the looped pile static reduction blanket, and a technique to neutralize static and static patterns from a polymeric film surface during processing, to enable higher speeds and fewer defects during web transport and subsequent processing of wound film rolls, an apparatus including
(Continued)

the looped pile static reduction cloth, and a technique to neutralize static from a polymeric shaped part during processing, to enable fewer defects. The looped pile static reduction blanket includes a static reduction engagement cloth that is resilient and can facilitate discharge of static from a web to ground before, during, and after contact with a charged web.

28 Claims, 4 Drawing Sheets

(52) U.S. Cl.
CPC .... *B65H 2401/14* (2013.01); *B65H 2401/141* (2013.01); *B65H 2404/533* (2013.01); *B65H 2404/5331* (2013.01); *B65H 2404/5511* (2013.01)

(58) Field of Classification Search
CPC ..... B65H 2301/41427; B65H 2301/41428; B65H 2301/5133; B65H 2401/141; B65H 2404/114; B65H 2404/232; B65H 2404/5331; B65H 2404/55; B65H 2404/5511; B65H 2404/56; B65H 2511/166; B65H 2515/716; B65H 27/00; B65H 2701/1752; B65H 29/242; B65H 5/224; B65H 75/10; B65H 75/28; B65H 2301/511; B65H 2401/14; B65H 2404/533; H01L 23/60; H05F 3/02; H05F 3/025; B08B 6/00; B41N 2207/02; B41N 2207/14; B41N 7/00; Y10T 428/1362; Y10T 428/23957; Y10T 428/23979; Y10T 442/413; Y10T 442/425; Y10T 442/2418; C08K 5/0075; C08K 2201/001; C09D 5/24; D06M 2200/00; D06N 2209/04; D06N 2209/041; D06N 2209/046
USPC ..... 361/220; 442/110
See application file for complete search history.

(56) References Cited

U.S. PATENT DOCUMENTS 3,678,675 A 7/1972 Klein
3,690,057 A 9/1972 Norris
3,986,530 A * 10/1976 Maekawa ..... A41D 31/0066 139/425 R
4,557,968 A * 12/1985 Thornton ..... A41D 31/0066 139/425 R
4,672,825 A 6/1987 Yasukawa et al.
4,940,521 A * 7/1990 Dinter ..... B29C 59/12 118/620
5,142,759 A * 9/1992 Bonander ..... B65H 27/00 492/48
5,508,879 A * 4/1996 Kitamura ..... G03G 15/0131 361/221
5,605,607 A * 2/1997 LaRose ..... B65H 23/00 204/164
5,710,692 A 1/1998 Muck
6,120,864 A * 9/2000 Chiricosta ..... B08B 6/00 15/1.51
6,192,800 B1 2/2001 DeMoore
8,784,940 B2 * 7/2014 Newhouse ..... B65H 27/00 427/394
9,637,315 B2 * 5/2017 Johanson ..... B65G 21/2036
9,845,216 B2 * 12/2017 Newhouse ..... B65H 27/00
9,908,733 B2 * 3/2018 Roska ..... B65H 27/00
2006/0281382 A1 * 12/2006 Karayianni ..... D03D 1/0088 442/181
2011/0103837 A1 * 5/2011 Toyoda ..... G03G 15/751 399/174
2013/0056553 A1 3/2013 Mouchoux
2013/0062521 A1 3/2013 Hirayama
2015/0274483 A1 * 10/2015 Newhouse ..... B65H 19/28 242/613
2016/0185549 A1 6/2016 Roska et al.
2016/0289034 A1 * 10/2016 Shoji ..... B65H 5/226
2017/0275121 A1 * 9/2017 Retterath ..... B65H 27/00

FOREIGN PATENT DOCUMENTS

GB 976027 A * 11/1964 ..... H05F 3/00
JP 7-135087 5/1995
JP 7-142184 6/1995
JP 7-204076 8/1995
JP 2005-344245 12/2005
WO WO 99/41023 8/1999
WO WO 2011-038248 3/2011
WO WO 2011-038279 3/2011
WO WO 2014-099951 6/2014

OTHER PUBLICATIONS

Hull, "A Method for Studying the Distribution and Sign of Static Charges on Solid Materials", Journal of Applied Physics, Dec. 1949, vol. 20, pp. 1157-1159.
International Search Report for PCT Application No. PCT/US2014/071096 dated Mar. 2, 2015, 4 pages.
Fact Sheet K0073 Global, "Static Electricity Safety Bulletin", Apr. 9, 2003, Kraton Polymers, Belpre, Ohio, 6 pages.

* cited by examiner

ARTICLES FOR ELIMINATING STATIC ELECTRICITY AND METHODS FOR THEIR USE

FIELD

The present invention relates to static elimination articles and methods of use.

BACKGROUND

Many products are often manufactured in a continuous web format for the processing efficiencies and capabilities that can be achieved with that approach. The term "web" is used herein to describe thin materials which are manufactured or processed in continuous, flexible strip form. Illustrative examples include thin plastics, paper, textiles, metals, and composites of such materials.

Such operations typically entail use of one or more, frequently many more, rollers around which the web is conveyed throughout a series of treatments, manufacturing steps, etc. Rollers are used for many purposes, including, for example, unwinding a wound roll of the web material, turning the direction of the web, applying pressure to the web in nip stations, positioning the web for travel through coating and other treatment stations, positioning multiple webs for lamination, stretching webs, etc., and winding up a roll of the web material. Webs can develop large static charges during unwinding or winding of rolls, as well as while passing over rollers in a web processing line. The strong electrostatic fields associated with these charges can cause surface contamination of the webs by attracting dust particles, fibers, bugs, hair, processing debris, and the like. A large static charge residing on a wound roll can also present a safety hazard. It is often necessary to use alarmed devices to keep human operators out of the areas of unwinding stations and winders for their safety.

Existing methods for eliminating static charge on a wound roll have drawbacks. Ionized air is often blown into winder or unwind station areas. This has some beneficial effect, but does not greatly diminish static charge, and in the act of blowing air toward the web, dust, debris, and the like may be brought into proximity of the static-charged web which would not otherwise be so introduced. So-called "static string" products are also often used. They are also limited in their effect, and require precise spacing from the charged web in order to maximize their effect. An apparatus and technique are needed to reliably reduce static electricity generated on polymeric film.

Many products are manufactured by thermoforming, or by injection molding, or by conversion of web materials via die-cutting or laser-cutting or the like, or are otherwise produced in such a manner as to provide a discrete shaped part. Such shaped parts may develop and bear a large static charge as a result of handling, forming, or converting processes. The strong electrostatic fields associated with these charges can cause surface contamination of the shaped parts by attracting dust particles, fibers, bugs, hair, processing debris, and the like. A large static charge residing on a shaped part can also present a safety hazard.

Existing methods for eliminating static charge on shaped parts have drawbacks. An apparatus and technique are needed to reliably reduce static electricity generated on polymeric shaped parts.

SUMMARY

The present invention provides a looped pile static reduction blanket or cloth, an apparatus including the looped pile static reduction blanket, a technique to neutralize static and static patterns from a polymeric film surface during processing, to enable higher speeds and fewer defects during web transport and subsequent processing of wound web rolls, an apparatus including the looped pile static reduction cloth, and a technique to neutralize static from a polymeric shaped part during processing, to enable fewer defects. The looped pile static reduction blanket includes a static reduction engagement cloth that is resilient and can facilitate discharge of static from the web to ground before, during, and after contact with a charged web. In one aspect, the present invention provides a static reduction blanket that includes a static reduction engagement cloth having an inner surface and an outer surface, the outer surface intended for contact with the web when in use. The static reduction engagement cloth includes a resilient engagement surface; and electrically conductive fibers, wherein the electrically conductive fibers are disposed throughout the resilient engagement surface such that a portion of the electrically conductive fibers are proximate the outer surface.

In another aspect, the present invention provides an apparatus for reducing static on a web that includes a static reduction blanket. The static reduction blanket includes a static reduction engagement cloth having an inner surface and an outer engagement surface, the outer surface in contact with the moving web. The engagement surface of the static reduction cloth is resilient and comprises electrically conductive fibers, wherein the electrically conductive fibers are disposed throughout the resilient engagement surface such that a portion of the electrically conductive fibers are proximate the outer surface so as to be capable of effective electrically conductive connection with a web or part as desired. The apparatus further includes an electrically conductive member, such as conductive structural member 130 shown in FIGS. 1A and 1B, in electrical contact with the inner surface of the static reduction blanket and in electrical contact with an electrical ground, wherein a first major surface of a web material contacts the static reduction blanket.

In yet another aspect, the present invention provides a method for reducing static on a web that includes providing the apparatus for removing static on a web; conveying the web material in a downweb direction; and contacting the moving web material with the resilient engagement surface of the static reduction blanket, thereby removing static charge from the web material and discharging the static charge to the electrical ground.

In yet another aspect, the present invention provides the method for reducing static on a web further including charging the web material with a corona discharge prior to contacting the moving web material with the resilient engagement surface.

In yet another aspect, the present invention provides an apparatus for reducing static on a shaped part that includes a static reduction cloth. The static reduction cloth includes a static reduction engagement cloth having an inner surface and an outer surface, the inner surface intended for contact with an operator. The static reduction cloth includes a resilient engagement surface; and electrically conductive fibers, wherein the electrically conductive fibers are disposed throughout the resilient engagement surface such that a portion of the electrically conductive fibers are proximate the outer surface. The apparatus further includes an electrically conductive member in electrical contact with the static reduction blanket and in electrical contact with an electrical ground, wherein a shaped part contacts the static reduction cloth.

In yet another aspect, the present invention provides a method for reducing static on a shaped part that includes providing the apparatus for removing static on a shaped part; rubbing the shaped part with the resilient engagement surface of the static reduction cloth, thereby removing static charge from the shaped part and discharging the static charge to the electrical ground.

The above summary is not intended to describe each disclosed embodiment or every implementation of the present invention. The figures and the detailed description below more particularly exemplify illustrative embodiments.

BRIEF DESCRIPTION OF THE DRAWINGS

The invention is further explained with reference to the drawing wherein.

The figures are not to scale. Like numbers used in the figures refer to like components. However, it will be understood that the use of a number to refer to a component in a given figure is not intended to limit the component in another figure labeled with the same number.

DETAILED DESCRIPTION OF ILLUSTRATIVE EMBODIMENTS

Figure 1A:
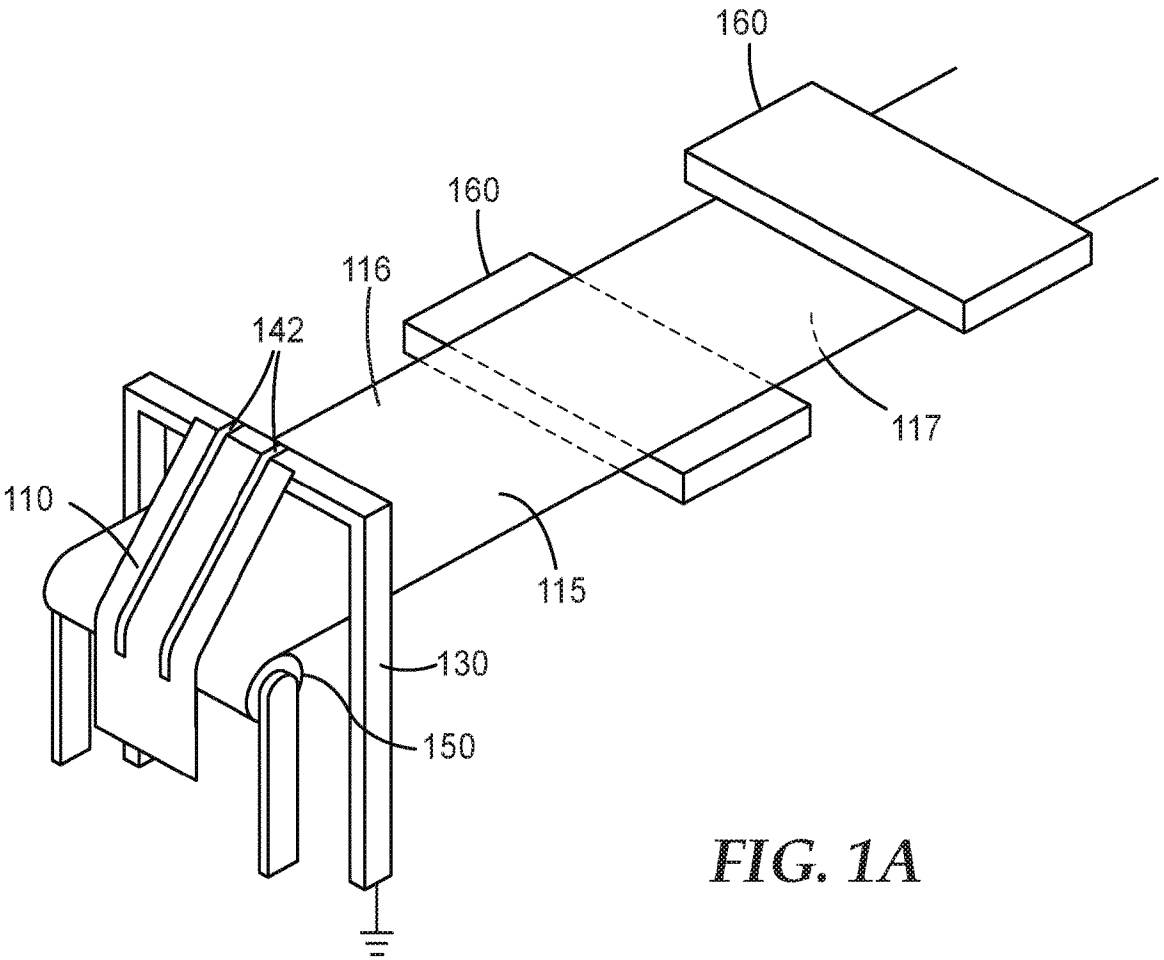
FIGS. 1A and 1B show illustrative embodiments of a static reduction blanket installed on a winder.

Static electricity is known to be generated during polymeric film making, film transport, and film coating, film conversion and treating processes including corona treatment, as well as in the formation and handling of polymeric shaped parts. Static patterns are an electrostatic charge on film surfaces which can persist even after treatment with readily available static neutralization devices. As a result of these static patterns, defects in the polymeric film can occur, including increased affinity for debris, coating defects particularly in non-polar solvent formulations, and liquid coating flow distortions. In one aspect, the present invention describes a looped pile static reduction blanket, an apparatus including the looped pile static reduction blanket, and a technique to neutralize static patterns from a polymeric film surface during winding or unwinding, to enable higher speeds and fewer defects during web processing. The looped pile static reduction blanket apparatus includes a means for grounding, typically a grounding tape.

The disclosed static reduction blankets can eliminate surface static that has built up on plastic or polymeric films and have the potential to be installed on nearly every film winding or unwinding station on nearly every type of web processing line. The disclosed static reduction blankets can also be installed in areas where currently available static reduction systems cannot be readily fitted, such as in applications on winders and unwinders that rotate. Further, the disclosed static reduction blankets do not require maintenance and can be replaced at low cost in comparison to currently available static reduction systems. The apparatus can be placed or installed in close proximity of solvent based coating equipment to control the explosion hazards due to surface static.

The disclosed static reduction cloths are compositionally similar to the static reduction blankets, and are intended for use with shaped parts which have developed a static charge. They may be used, to wipe away the static charge from a shaped part, either by a human operator, or by programmed robotic equipment known in the art and suited to the purpose.

The following terms are used herein as having the indicated meaning; other terms are defined elsewhere in the specification.

"Convey" is used to mean moving a web from a first position to a second position wherein the web passes through engaging contact with a roller.

"Engagement surface" is used to mean the surface of the static reduction blanket or cloth that is directly contacted with the web or shaped part.

"Resilient" is used to refer to the capability of being deformed or compressed and then recovering to earlier shape or loft.

"Web" refers to a flexible, elongated ribbon or a continuous, in one direction, sheet of material.

In the following description, reference is made to the accompanying drawings that forms a part hereof and in which are shown by way of illustration. It is to be understood that other embodiments are contemplated and may be made without departing from the scope or spirit of the present invention. The following detailed description, therefore, is not to be taken in a limiting sense.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise.

Spatially related terms, including but not limited to, "lower," "upper," "beneath," "below," "above," and "on top," if used herein, are utilized for ease of description to describe spatial relationships of an element(s) to another. Such spatially related terms encompass different orientations of the device in use or operation in addition to the particular orientations depicted in the figures and described herein. For example, if an object depicted in the figures is turned over or flipped over, portions previously described as below or beneath other elements would then be above those other elements.

As used herein, when an element, component or layer for example is described as forming a "coincident interface" with, or being "on" "connected to," "coupled with" or "in contact with" another element, component or layer, it can be directly on, directly connected to, directly coupled with, in direct contact with, or intervening elements, components or layers may be on, connected, coupled or in contact with the particular element, component or layer, for example. When an element, component or layer for example is referred to as being "directly on," "directly connected to," "directly coupled with," or "directly in contact with" another element, there are no intervening elements, components or layers for example.

Film rollers having coverings that use looped pile engagement covers have been described for use with transport rollers in a web line, for example, in PCT Patent Publn. Nos. WO 2011/038279, and 2011/038248; and also in US Patent Appln. Publn. Nos. 2013/056553 and 2013/062521. Film rollers having coverings that use looped pile exteriors providing a resilient engagement surface have been described for static reduction use in a web line, for example, in PCT Appln. No. WO2014/099951.

Static electricity can be generated during polymeric film making, film transport, and film coating and treating processes (e.g., corona treatment, etc.). The positive and negative charges that can be generated either attract or repel each other, as known in the art. A charged film of either polarity can be attracted to uncharged insulators or conductor surfaces. These attractions become especially evident in converting operations such as sheeting, bag making and die-cutting, where the film is no longer constrained by the mechanical structure of the web and its transport system. Polymeric film webs can develop high charge levels with field strengths in the range of 10 kilovolts/centimeter (kV/cm) to 40 kV/cm or more.

The strong electrostatic fields associated with these high charges can cause surface contamination of the webs by attracting dust particles, fibers, bugs, hair, processing debris, and the like. Surface contamination can cause quality problems with printing, coating, and laminating, and cleanliness problems with food, medical and pharmaceutical packaging films. Control of high levels of static is very important in many industries, and the equipment and techniques to control static are referred to as static neutralizers and static control technology.

Some of the problems due to static include: uneven coatings and "wicking" of inks; electrostatic discharge (ESD) of a charged conductor or a highly charged insulator, which can result in ignition of hazardous vapors in coating heads and gravure printing operations; ESD disruption of operations of programmable logic controllers and sensing equipment which can cause processing errors and costly down time; and high static charges, especially on a wind-up roll, can result in uncomfortable or even harmful electrical shocks to the operator when approaching the roll or touching the machine frame.

High levels of static can also result in air-breakdown discharges, which can supply counter ions that result in bipolar static patterns. These bipolar static patterns can be described as an electrostatic charge on one or both of the film surfaces, which can persist even after treatment with readily available static neutralization devices. Defects in the polymeric film can occur as a result of these bipolar static patterns. These defects can include, for example, an increased affinity for debris; coating defects, particularly in non-polar solvent formulations; and liquid coating flow distortions. Because of their bipolar nature, these bipolar static patterns can effectively screen themselves from conventional static neutralizing technology, which relies on the establishment of an electric field between the neutralizer and the substrate to attract ions having the appropriate polarity.

Many films or substrates are non-conductive, so they cannot be neutralized by intimate contact with conductive grounding. In these cases, counter-ions must be produced to counter or neutralize the static charges. A fundamental of static control technology with non-conductive films or substrates is that all neutralizers must produce ions, which can then be attracted by the charge on a film or substrate. If the initial charge on the film is positive, negative ions will be attracted; when these negative ions reach the film, they neutralize at least a portion of the positive charge on the film. A similar effect occurs if the film or substrate is negatively charged, with positive ions being attracted and thereby neutralizing at least a portion of the negative charge on the film.

The technique of ion production is different for the various types of neutralizers. Radioactive neutralizers produce ions of both polarities by ionizing the surrounding air with either alpha or beta radiation. Radioactive neutralizers can be limited in their efficiency, and the use of radioactive materials may be undesired in many locations.

Other types of neutralizers use corona discharge to produce these ions. A corona discharge is a partial electric breakdown in a gaseous medium, which occurs between two electrodes. The electrode pairs are often asymmetrically shaped, for example pairing a point and plane. In this type of geometry, a non-uniform electric field in the inter-electrode gap will result from a voltage potential difference. The electric field will be more intense at the sharp electrode, typically referred to as the high field electrode. If the voltage potential difference is high enough, the breakdown field strength of the air can be exceeded near the high field electrode, which can then result in air ionization and the formation of ion pairs. This type of neutralizer can be classified into two distinct types: 1) active (i.e., powered) neutralizers and 2) passive (i.e., unpowered) neutralizers.

In active neutralizers, a voltage potential difference is applied between a pointed electrode and the housing of the neutralizer. A charged film in front of the neutralizer distorts the electric field such that a portion of the ions having an opposite polarity are attracted by the film. Active neutralizers also produce ions when the charge density on the film is low. There is no threshold value (i.e., onset of current flow) for an active neutralizer, because the electric field strength at the high field electrode is mainly determined by the potential difference between the high field electrode and the housing (a value set by the power supply). There are DC (direct current) and AC (alternating current) neutralizers (with respectively a DC and an AC potential difference between corona electrode and housing). Active neutralizers can have advantages of efficiency, where large numbers of ions pairs can be produced, but can also have many limitations, including: over-compensating, high voltage power connection dangers, and expense.

In contrast, passive neutralizers rely on asymmetric geometry and the resultant electric field generated from the close proximity of a charged film or substrate to the high field electrode of the passive neutralizer to produce ion pairs. A common passive neutralizer system often consists of either needles or metallic brushes, electrically connected to earth ground, suspended above the surface to be neutralized. The highly charged surface sets up a potential gradient between the needle or bustle points and the charged body. When a threshold level of voltage is achieved, the electric field will be sufficient to ionize air in the immediate vicinity of the needle or bustle points. The threshold level of voltage determines the level of voltage reduction that can be achieved. This system is known as the induction method of ionization, because of the induced charge in the passive static eliminator. In order to maximize the amount of induced charges, the passive neutralizer system must adequately grounded.

One common application is to connect the passive neutralizer to earth ground. If a grounded passive neutralizer is positioned over a charged film or substrate, and if the charge density on the film is high enough, a corona discharge can occur, creating ion pairs at the high field electrode of the passive neutralizer. The ions of the opposite polarity are attracted by the film or substrate, and subsequently neutralize its charge. No ions are produced if the charge density on the film or substrate is low, because then the breakdown field strength of the air is not reached at the surface of the passive neutralizers high field electrode. The onset of current flow to the charged film or substrate is termed the corona or voltage threshold of the neutralizer. One advantage of this system is its simplicity, needing no power supply. One disadvantage is the passive neutralizer no longer creates ion pairs below the threshold level of the corona, which can result in an inability to reduce the static charge to negligible levels under normal operating conditions. A passive neutralizer which can continue to create ion pairs under low voltage conditions (i.e., has a low corona threshold) is very advantageous. The static reduction engagement cloth described herein, can function with a low voltage threshold in several operating modes. Consequently the passive neutralizer of the present invention can reduce static levels to very low levels, similar to the low static levels achieved with active neutralizers but without the many limitations of active neutralizers.

Several factors can affect the corona threshold of passive neutralizers. In one particular embodiment, the sharpness of the high field electrode can contribute significantly to the corona threshold; the sharpness of the high field electrode can be due to, for example, the fiber diameter, a fiber end, a fiber kink, or a fiber bend.

In one particular embodiment, the proximity of other charge sources and grounds to the high field or ionizing electrode can also contribute significantly to the corona threshold. When the charged film web passes over an idler roll or comes into contact or close proximity to another surface, its field becomes partially or totally collapsed. Even though the web is still charged, its field cannot be detected and measured. This condition is known as field suppression or attenuation. The degree of suppression is dependent upon the distance relationship to the background surface, physical and electrical characteristics of the background surface, and the thickness of the charged material. Attempting field measurements in these conditions often results in errors when evaluating or auditing a process for static problems. In addition, in areas where field suppression is evident, passive static neutralizers cannot be effectively applied since the voltage of the film is lowered without neutralization, which is desired, but rather through attenuation. In some cases, the fiber diameter, the spacing and concentration of conductive fibers within the nonconductive fiber matrix, the spacing of the conductive fibers to the charged film or substrate during operation, and minimizing the attenuation effect of nearby conductive elements, can all be parameters which may be adjusted to affect the corona threshold. In one particular embodiment, the voltage attenuation can be reduced by engaging the roller cover of the present invention with a non-conductive roll.

The present invention may be used with a wide variety of web materials, illustrative examples including plastics, paper, metal, and composite films or foils. Web material will typically be provided in roll form (e.g., wound upon itself or on a core).

In some embodiments, the web material is provided from an intermediate storage state (e.g., from an inventory of raw materials and intermediate materials). In other embodiments, the web material may be provided to the process of the present invention directly from precursor processing (e.g., such as the take off feed from a film forming process). The web material may be single layer or multilayer, in some instances the web material may undergo manufacturing operations in which one or more additional layers and/or one or more treatments are applied to a web material.

In some cases, static patterns reflect an electrostatic charge, readily characterized by dusting, which can persist after treatment with static neutralization devices are formed during film making, film transport, and film coating processes, or during the process of corona treatment. When a polyethylene terephthalate (PET) film, or other polymeric film, is dusted with certain charged powders prior to neutralization with a static bar, many types of patterns can be observed, as described elsewhere. These patterns can be classified into two general types: unipolar and bipolar. The unipolar patterns are often tree shaped or large patchy areas. The bipolar patterns are typically concentric circles or arcs. If the PET film is neutralized with a static bar and then dusted, only the bipolar patterns remain. This is a direct result of the principle in which static eliminator bars operate. An electric field must be established between the film and the bar to attract ions of the appropriate polarity to the film. A bipolar pattern effectively screens itself from the static bar, hence the appearance of permanence. In addition, the bipolar nature of static patterns results in charge stability. High levels of charge density are possible due to the stabilizing presence of counter ions.

A functional test for bipolar static patterns includes a dispersion of $TiO_2$ and KRATON® SBR in toluene spread onto a PET film with a coating bar. Disruption of the coating occurs in identical locations of static patterns, as characterized by dusting, as described elsewhere. The bipolar static patterns should be removed from a film surface to avoid coating disruptions. In addition to higher quality coating higher process speeds are possible with minimal coating disruptions such as those due to static patterns.

Static patterns can be characterized by dusting. When fine powder (e.g., talc, NaHC03, etc.) is dusted onto the web, the powder will adhere strongly in certain regions yielding a pattern. More detailed information can be obtained by the use of charged powders. When fine powders of lycopodium and sulfur are mixed, their different charge affinities allow for a charge transfer to take place. The lycopodium powder (dyed blue) becomes positively charged while the sulfur (dyed red) becomes negatively charged. When a PET film is dusted with such a bipolar mixture, the polarity of charged regions is readily discernible (H. H. Hull, J. Appl. Phys., 20, 1157-1159, December 1949).

In one particular embodiment, a technique to neutralize static and static patterns is provided where a film is first charged via a DC corona process (using one or more corona discharge generator(s) 160) followed by contact with a static reduction blanket to draw away built up static charge. The DC corona process first alters the polarity of the static pattern, on a first major surface 116 to a unipolar state followed by contact with a static reduction blanket, and then an opposing major surface 117 is similarly treated. In one particular embodiment, the DC corona charges the film while the film is contact with a grounded backup roll to offer a consistent ground reference. The backup roll may have a dielectric coating or dielectric layer for improved wetting and to prevent air breakdown as the film leaves this roll.

The addition of multi-conductive filaments having a size range between about 3 to about 100 microns into circular knitted terry loops made of polyester, nylon, polypropylene, and ethylene (co)polymer materials can produce a blanket or cloth which can reduce or even eliminate pre-existing surface static on polymeric films. These static reduction blankets or cloths can be draped over an unwinding or winding roll of web material, or can be used to wipe the surfaces of a shaped part, respectively.

Static reduction blankets described herein may be used in conjunction with the static reduction rollers described in PCT Appln. No. WO2014/099951 with a static reduction blanket optionally used at an unwind station (if any) serving to reduce or eliminate static pre-existing in a web roll, static reduction rollers used in a web conveying apparatus to limit the build-up of static charge during web processing, and/or a static reduction blanket used at the winder (if any) serving to reduce or eliminate any remaining static charge. Depending upon the embodiment, a web conveying apparatus may comprise one or more static reduction rollers with engagement covers, and may further comprise one or more rollers not equipped with such engagement covers. Some embodiments will employ dozens or more rollers in sequence, with some, most, or even all of the rollers being equipped as static reduction rollers with engagement covers. In embodiments of apparatuses comprising two or more static reduction rollers equipped with static reduction engagement covers, the static reduction engagement covers may be selected to have different properties to optimize performance at different locations within the manufacturing sequence.

An advantage of the present invention is that typically static reduction blankets may be readily installed on winders or unwind stations without significant equipment change or significant reconfiguration of apparatus components. In addition, static reduction blankets may be used at any roller location in a web process line, in lieu of static reduction rollers with engagement covers, in situations where it would be physically difficult or otherwise inconvenient to employ static reduction rollers with engagement covers. Thus, existing web conveying apparatuses may be readily refit with static reduction blankets of the invention to achieve attendant improvements in performance.

As shown in FIG. 1A, a static reduction blanket 110 of the present invention is easily installed on a winder or unwind station. The blanket needs only to be supported above the web roll being wound or unwound, typically by physical attachment to some structural member of the winder or unwind station above the web roll, and allowed to drape, by force of gravity, such that it is in physical contact with the winding or unwinding web (e.g., at a portion which is in wound position on a roll or at location at which the web is being conveyed), and in a position so as to not interfere with the path of the moving web 115 entering the winder or exiting the unwind station.

In a typical embodiment, the blanket is made with a knit fabric having a pile-forming loop at every stitch. In an illustrative embodiment there are 25 stitches per inch (1 stitch per millimeter). The fibrous material(s) used to make the fabric may be single filament strands, multifilament strands (e.g., two or more strands wound together to yield a single thread), or combinations thereof.

In many embodiments, the looped pile has a loop height (i.e., dimension from the plane defined by the top of the base layer to the apex of the pile loops) of from about 0.4 to about 0.8 millimeter (mm), preferably from about 0.5 to about 0.7 mm. It will be understood that blankets having looped pile having loop heights outside this range may be used in certain embodiments. If the loop height is insufficient, the cloth may fail to provide effective cushioning effect to the web to achieve the full benefits of the invention. If the loop height is too high, the pile may tend to get floppy and undesirably affect web transport or damage the conveyed web.

The pile should be sufficiently dense to prevent so much compression, under gravity, when draped upon a web roll, that fibers of the ground fabric would make significant contact with the winding or unwinding web. For instance, the looped pile comprises fibers selected to have an appropriate denier for the application, with thicker fibers providing relatively greater resistance to compression. Illustrative examples include fibers having a denier from about 100 to about 500. As will be understood, fibers having a denier outside this range may be used in some embodiments in accordance with the invention.

In illustrative embodiments, there will be both non-electrically conductive fibers and electrically conductive fibers in the looped pile fabric In illustrative embodiments, the non-electrically conductive fibers can be selected from the group consisting of poly(tetrafluoroethylene) (e.g., TEFLON® fiber), aramid (e.g., KEVLAR®), polyester, polypropylene, nylon, wool, bamboo, cotton, or a combination thereof. However, those skilled in the art will be able to readily select other fibers which can be effectively knit and used in blankets and cloths of the invention. In some cases, the non-electrically conductive fibers can comprises a material that shrinks when exposed to heat, moisture, or a combination thereof, such as wool, cotton, polyvinylalcohol, polyester, or a combination thereof.

The static reduction blankets and cloths also contain electrically conductive fibers. The electrically conductive fibers can be selected from metal coated fibers such as aluminum, silver, copper or alloys thereof, coated non-electrically conductive fibers; metal fibers such as aluminum, silver, copper, or alloys thereof; carbon fibers, or a combination thereof. In one particular embodiment, a conductive polyester fiber such as RESISTAT® P6203 Polyester Filament (from Jarden Applied Materials, Columbia S.C.) can be used. In some cases, the electrically conductive fibers have a length that includes kinks, bumps, ends or a combination thereof, that form pointed conductive regions. The electrically conductive fibers can comprise a fiber having a size (diameter) ranging from about 3 microns to about 20 microns, although other size fibers can also be used. The electrically conductive fibers can have any length, including continuous fibers extending throughout the entire blanket or cloth. In some cases, the electrically conductive fibers comprise a plurality of ends, and are intertwined in electrical contact throughout the blanket or cloth. Electrically conducting fibers can be included in the fabric in such a way that they are uniformly distributed over the entire loop pile side of the fabric, or they may be included in such a way that they define patterns on the surface of the fabric, as is discussed in relation to the Figures.

Any knit fabric useful as an anti-static roller engagement cover as disclosed in PCT Appln. No. WO2014/099951 may be used as a blanket or cloth material in the present invention, either by knitting the same fiber types into a sheet form rather than a sleeve form, or by knitting into a sleeve form and then cutting and unrolling the sleeve into a sheet form.

Some illustrative examples of materials that can be cut and unrolled to be used as blankets and cloths of the present invention include: HS4-16 and HS6-23 polyester sleeves from Syfilco Ltd., Exeter, Ontario, Canada; WM-0401C, WM-0601, and WM-0801 polyester sleeves from Zodiac Fabrics Company, London, Ontario, Canada or its affiliate Carriff Corp., Midland, N.C.; and BBW3310TP-9.5 and BBW310TP-7.5 sleeves from Drum Filter Media, Inc., High Point, N.C.

Typically, knit fabrics are made using fibrous materials that have been treated with lubricants to facilitate the knitting process. When the resultant knit fabrics are used in web conveyance operations in accordance with the invention, such lubricants may tend to wear away causing variation in frictional performance to the web and potential contamination issues. Accordingly, it is typically preferred to wash or scour fabrics used as blankets or cloths herein.

The material(s) selected should be compatible with the web materials or shaped parts to be treated and operating conditions (e.g., stable and durable under the ambient operating conditions (e.g., temperature, humidity, materials present, etc.)). It has been observed that, if the static reduction blankets and cloths are of contrasting color to the web materials and shaped parts, observation of debris capture by the static reduction blanket or cloth is facilitated (e.g., using black polyester fibers in a static reduction blanket to be used with a transparent film web).

Typically, because of the requirements of the knitting processes used to make them, knit fabrics are made with fibrous materials that have limited elastomeric character so that the fibers can be moved around in contact with one another to form the desired knit. In many instances, lubricants are applied to the fibers to facilitate the knitting process. It is preferred to remove such lubricants from knits used in the present invention (e.g., by cleaning or scouring the material such as by washing it before using it). In some instances, the knit can be put into service as a blanket or cloth of the invention with a lubricant being worn away.

The static reduction blankets can be used in connection with a wide variety of web materials. They are well suited and can provide particular advantage in connection with the manufacture and handling of webs of high quality polymeric materials such as optical films. Such films, typically comprising one or more layers of select polymeric materials (e.g., radiation-cured compositions) typically require precise and uniform specifications of width, thickness, film properties, etc. with very low defect rates. The web material may be of monolayer or multilayer construction.

In some embodiments, the web is a simple film (e.g., polyester (e.g., photograde polyethylene terephthalate and MELINEX™ PET from DuPont Films) or polycarbonate). In some embodiments, the film comprises such materials as, for example, styrene-acrylonitrile, cellulose acetate butyrate, cellulose acetate propionate, cellulose triacetate, polyether sulfone, polymethyl methacrylate, polyurethane, polyester, polycarbonate, polyvinyl chloride, polystyrene, polyethylene naphthalate, copolymers or blends based on naphthalene dicarboxylic acids, polycyclo-olefins, and polyimides.

The static reduction blankets described herein have a low modulus of elasticity in the thickness direction, with enhanced tribological characteristics. As a result, the invention provides a convenient, low cost way to reduce undesirable effects due to static charge on the web during web transport and handling, without introducing other defects such as scratches or scuffs.

High quality webs (e.g., optical grade webs) can be processed to reduce static charge at high speeds (e.g., 100 feet per minute (fpm), 150 fpm, 170 fpm, 200 fpm, 300 fpm, 400 fpm, or more) with little or no web degradation (e.g., buckling, scuffing, scratching, etc.). Furthermore, the pile construction is believed to entrap contamination (e.g., dirt particles) that would otherwise damage the web being processed.

In addition to their use on winders and unwind stations, the static reduction blankets described herein may also be used by draping upon the film as it passes over any individual roller on a web transport apparatus, and they may be used on just one or two rollers, or on many rollers. The static reduction blankets may be used in conjunction with static reduction engagement covers disclosed in PCT Appln. No. WO2014/099951. Static reduction blankets and static reduction rollers may be employed at different locations on the same web processing line. It is also possible to employ a static reduction blanket of the current invention draped upon the film passing over a roller equipped with a static reduction engagement cover. In terms of comparison, static reduction rollers may be the solution of choice when it is physically possible and economically advantageous to retrofit existing rollers on a web process line, because it is often easier to guarantee a secure connection to ground. Static reduction rollers may also be the solution of choice when one of their myriad other advantages is desirable in addition to static charge reduction. Conversely, static reduction blankets may be the solution of choice in situations where the configuration of the web process line makes it difficult to employ covered rollers, or economically disadvantageous to do so, or other advantages derived from the covered rollers are not needed, as the static reduction blankets are likely to be a simpler and less expensive solution. Winders and unwind stations are two such locations on most web process lines, and are thus emphasized in this invention, though use of static reduction blankets is not so limited.

In addition to their use in a draped configuration upon a film passing over a roller, static reduction blankets may also be productively employed in a configuration in which the blanket merely makes brushing contact with the edge of the film, rather than being draped upon the film in such a way as to make contact with the major surface of the film.

Static reduction blankets and cloths are advantageously used such that the electrically conductive surface makes electrical contact to ground.

Figure 1B:
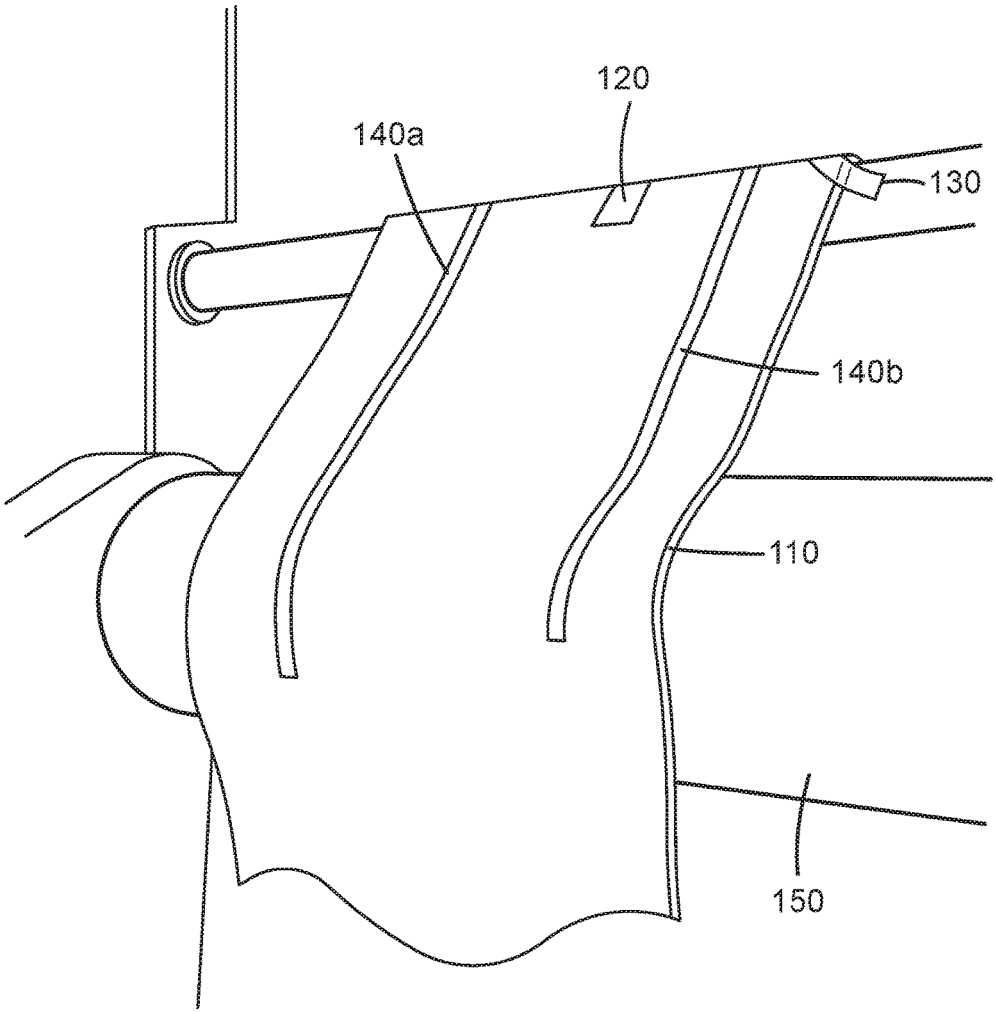

FIG. 1B shows an illustrative simple static reduction blanket installation on a winder. Static reduction blanket 110 is draped over, and affixed by adhesive tape 120 to, a conductive structural member 130 of the winder, which is in electrical contact with machine ground. Electrical contact between the blanket 110 and the conductive structural member 130 is optionally enhanced by the presence of two strips 140*a* and 140*b* of conductive tape, which are adhered via conductive adhesive (not shown) at their upper ends to the conductive structural member 130 and along the remainder of their lengths to the blanket 110. The blanket 110 is draped over the roll being wound 150.

A useful conductive tape for enhancement of grounding is 3M® 1181 TAPE (3M Company, St. Paul, Minn.) which comprises a copper foil backing with a conductive adhesive on one side. Other similar products could be used and the precise method of ensuring a good ground for the blanket is not critical. Other methods might include, for example, a hook-and-loop type fastener system made to be conductive by the choice of materials of its construction (e.g., metal or a metal-coated non-metal component). Also, conductive tape or other conductive fasteners could be spatially arranged in ways other than that shown in FIG. 1B, so long as a secure electrical connection between the blanket and the member in contact with ground is achieved.

Figure 2:
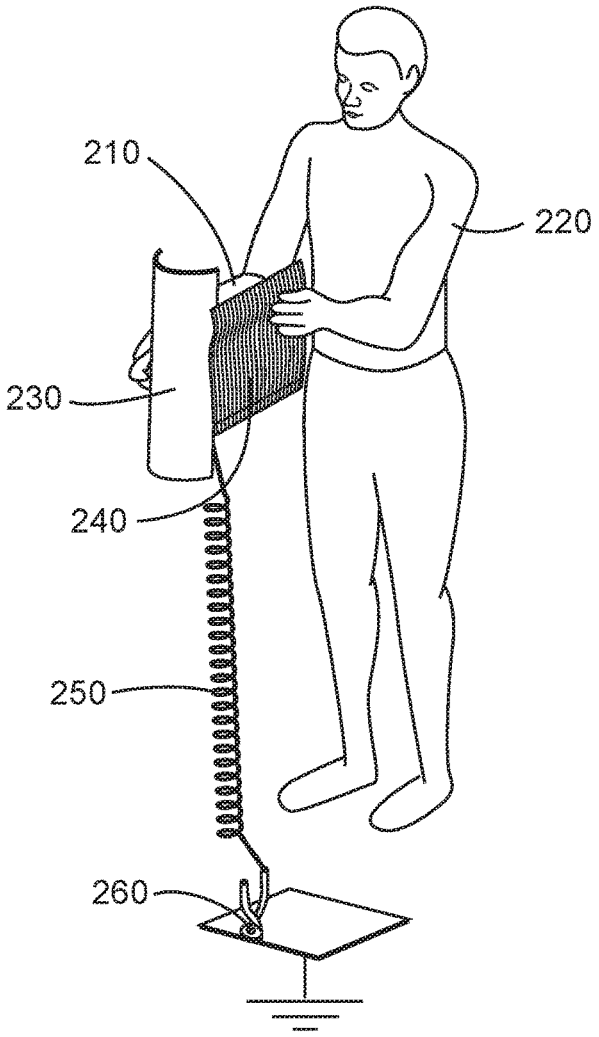
FIG. 2 shows a schematic view of a static reduction cloth of the invention being used by an operator.

FIG. 2 shows schematically a static reduction cloth 210 of this invention in use by a human operator 220 to reduce static charge on a shaped part 230. Human operator 220 could be replaced by a robotic or other mechanized device and the appropriate operating software. The static reduction cloth 210 would in all ways excepting physical size and shape be identical to the static reduction blankets of the present invention. Size and shape of the static reduction cloth 210 would be dictated by the shaped part to be treated, ergonomic considerations, etc. The static reduction cloth 210 is in physical contact with an optional conductive clamping device 240. Either the conductive clamping device 240 or the cloth 210 itself is connected via a conductive cord 250 to ground 260. Other methods known in the art of grounding the static reduction cloth may also be used.

Static reduction cloths may find use, for example, in the automotive and automotive aftermarket industries, in which static charge on shaped parts is disruptive to painting operations and the like. The debris-entrapment feature often displayed by the closed-loop pile fabrics useful for static reduction cloths make the static reduction cloths ideal for simultaneously cleaning a shaped part and reducing its level of static charge, whereas most prior art cleaning cloths actually impart additional static charge via the rubbing action necessary to cleaning. Static reduction cloths may also find application for manufacture and repair of circuit boards and other electronic components. Other uses will be apparent to one of skill in the arts of cleaning and mitigating static charge of shaped parts.

Figure 3:
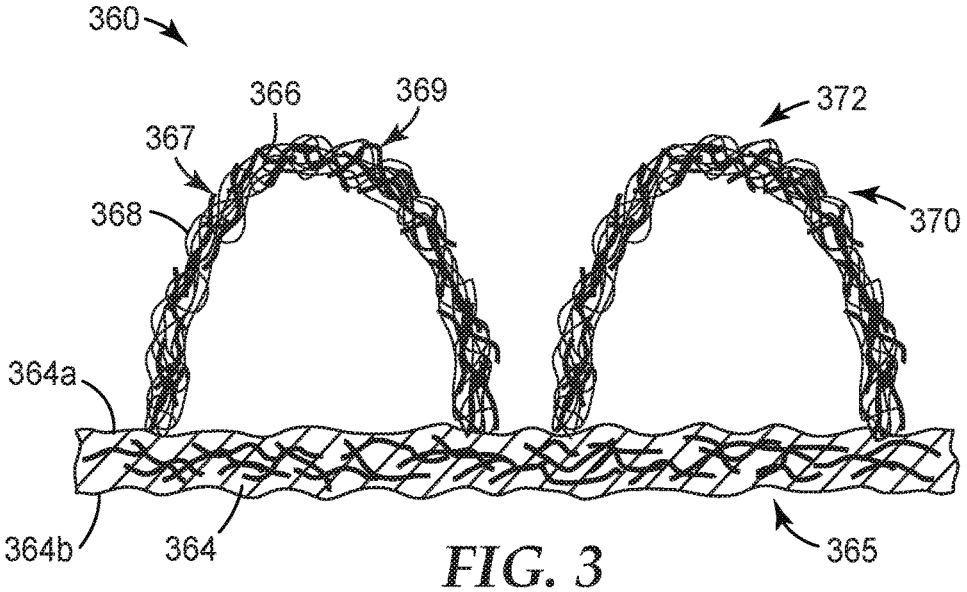
FIG. 3 shows an enlarged schematic view of the conductive portion of the static reduction blanket or cloth.

FIG. 3 shows an enlarged view of a portion of a static reduction blanket or cloth conductive portion, according to one aspect of the invention. The static reduction engagement cloth 360 conductive portion includes the base layer 364 (which has a first face 364*a* and a second face 364*b*; the second face forming the inner surface 365 of the static engagement reduction cloth 360) and resilient looped pile fabric 368 (which forms the resilient engagement surface 370 and the outer surface 372 of the static engagement reduction cloth 360), into which the electrically conductive fibers 366 extend. In one particular embodiment, the electrically conductive fibers 366 can include a plurality of ends 367 and kinks 369 that collectively form points from which corona discharge has been shown to be more readily generated, as described elsewhere. The plurality of ends 367 can be formed using several techniques including, for example, by using short electrically conductive fibers 366, or by fracturing or cutting longer electrically conductive fibers 366 in the region of the resilient looped pile fabric 368. In a similar manner, the plurality of kinks 369 (or alternately bumps) can be formed using several techniques including, for example, compressing, crumpling, or folding during manufacture of the electrically conductive fibers 366.

It is typically preferred that the conductive fibers in the base layer be substantially continuous and extend throughout the base layer (to provide an effective connection to ground) and that the conductive fibers within the looped pile be in fractured or kinked form as discussed above. In addition, it is also preferred in some embodiments that the concentration of conductive fibers within the looped pile be lower than that in the base layer.

The electrically conductive fibers can be selected from metal coated fibers such as aluminum, silver, copper or alloys thereof, coated non-electrically conductive fibers 168; metal fibers such as aluminum, silver, copper, or alloys thereof; carbon fibers, or a combination thereof. In one particular embodiment, a conductive polyester fiber such as RESISTAT® P6203 Polyester Filament (from Jarden Applied Materials) can be used. In some cases, the electrically conductive fibers have a length that includes kinks, bumps, ends or a combination thereof, that form pointed conductive regions. The electrically conductive fibers can comprise a fiber having a size (diameter) ranging from about 3 microns to about 20 microns, although other size fibers can also be used.

Figure 4A:
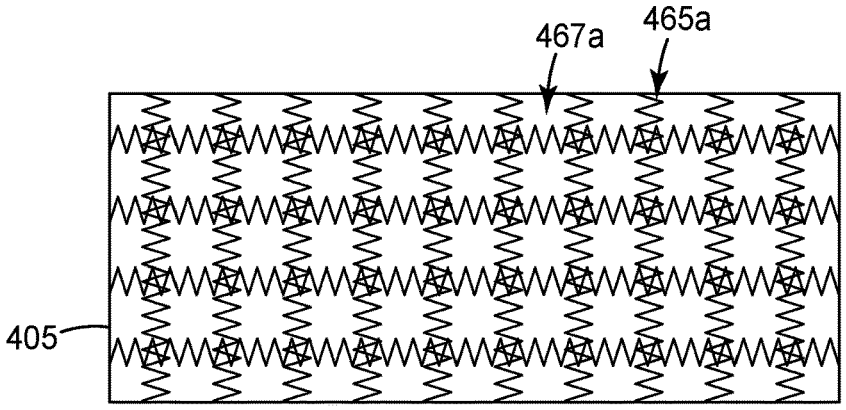
FIGS. 4A-4C show plan views of the engagement surface of illustrative embodiments of static reduction blanket or cloths of the invention having different conductive patterns.
Figure 4B:
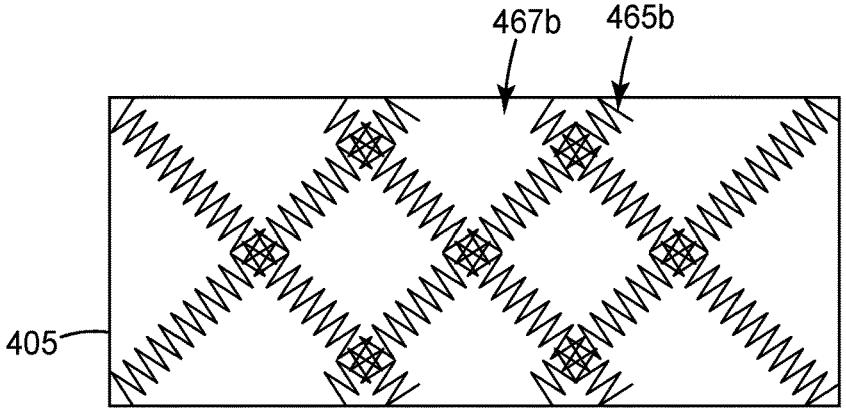
Figure 4C:
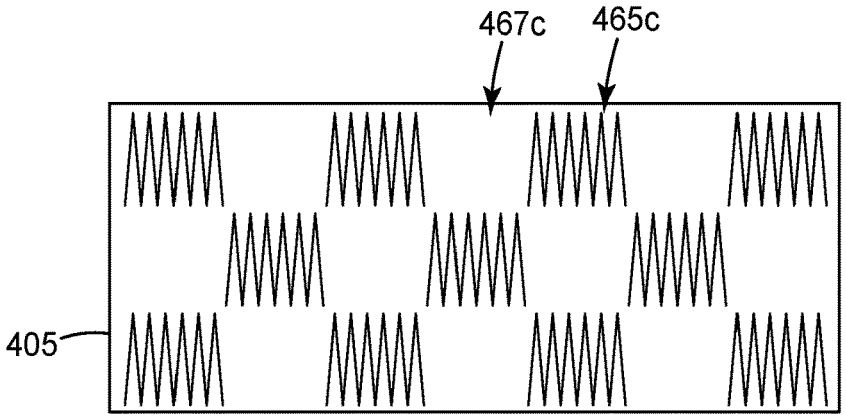

FIG. 4A-4C shows illustrative embodiments of static reduction blanket or cloth conductive patterns of the invention. In FIG. 4A, a blanket 405 includes electrically conductive loop pile regions 465*a* and non-conductive loop pile regions 467*a* arranged in a grid pattern. In FIG. 4B, a blanket 405 includes electrically conductive loop pile regions 465*b* and non-conductive loop pile regions 467*b* arranged in a diamond pattern. In FIG. 4C, a blanket 405 includes electrically conductive loop pile regions 465*c* and non-conductive loop pile regions 467*c* arranged in a checkerboard pattern. Other embodiments of static reduction blanket or cloth conductive patterns are possible and will be apparent to one of skill in the art, and these illustrative embodiments are not meant to be limiting.

EXAMPLES

The invention may be further understood with reference to the following illustrative examples.

Example 1

A static reduction blanket was made of polyester with a conductive row of fibers every twelfth row. Each conductive row consisted of a ground stitch made of a silver coated polyester yarn, X-Static®, from Noble Biomaterials, Scranton, Pa. With each conductive row there was a terry loop which was made up of a spun yarn having 50% polyester fibers and 50% X-Static®. The material was knit in the form of a sleeve, and the sleeve was then cut with scissors along the axial direction and unrolled into a sheet form. The blanket was installed on the winder of a pilot-scale biaxial orientation process polyethylene terephthalate film line. The blanket was physically affixed to a conducting metal structural rod positioned above the film roll being wound, using adhesive tape. The loop pile side of the blanket was configured to be "face down" upon the film roll being wound. The structural metal rod was in contact with machine ground. The blanket was brought into improved electrical contact with the structural metal rod using two strips of 3M® 1181 TAPE. Each strip was contacted via its adhesive securely to the structural metal rod, and then secured via its adhesive over a long length along the blanket, on the side opposite the loop pile, in the direction of drape. The pilot line was run at a speed typical for its use for polyester film production. A 3M® 718 Static Field Meter (3M) was used to measure the static field strength of the film at a location just prior to its application onto the roll being wound. At this location, the field meter recorded a field strength of 20 KV/cm. The same meter was used to measure the static field strength at a second location, this one on the film roll being wound, but at a point beyond (in the direction of rotation) the area of contact between the blanket and the film roll being wound. At this location the field meter recorded a field strength of 0.0 KV/cm.

Example 2

A static reduction blanket was made of polyester with a conductive row of fibers every twelfth row. Each conductive row consisted of a ground stitch made of a silver coated polyester yarn, X-Static®. With each conductive row there was a terry loop which was made up of a spun yarn having 50% polyester fibers and 50% X-Static®. The material was knit in the form of a sleeve, and the sleeve was then cut with scissors along the axial direction and unrolled into a sheet form. The blanket was installed on the winder of a production-scale biaxial orientation process polyethylene terephthalate film line. The blanket was physically affixed to a conducting metal structural rod positioned above the film roll being wound, using adhesive tape. The loop pile side of the blanket was configured to be "face down" upon the film roll being wound. The structural metal rod was in contact with machine ground. The blanket was brought into improved electrical contact with the structural metal rod using two strips of 3M® 1181 TAPE. Each strip was contacted via its adhesive securely to the structural metal rod, and then secured via its adhesive over a long length along the blanket, on the side opposite the loop pile, in the direction of drape. The production line was run at a speed typical for its use for polyester film production. A 3M® 718 Static Field Meter was used to measure the static field strength of the film at a location just prior to its application onto the roll being wound. At this location, the field meter recorded a field strength of 20 KV/cm. The same meter was used to measure the static field strength at a second location, this one on the film roll being wound, but at a point beyond (in the direction of rotation) the area of contact between the blanket and the film roll being wound. At this location the field meter recorded a field strength of 0.4 KV/cm.

Examples 3-5

A static reduction blanket was made of polyester with a conductive row of fibers every twelfth row. Each conductive row consisted of a ground stitch made of a silver coated polyester yarn, X-Static®. With each conductive row there was a terry loop which was made up of a spun yarn having 50% polyester fibers and 50% X-Static®. The material was knit in the form of a sleeve, and the sleeve was then cut with scissors along the axial direction and unrolled into a sheet form. The blanket was installed on the winder of the production-scale biaxial orientation process polyethylene terephthalate film line of Example 2. The blanket was physically affixed to a conducting metal structural rod positioned above the film roll being wound, using adhesive tape. The loop pile side of the blanket was configured to be "face down" upon the film roll being wound. The structural metal rod was in contact with machine ground. The blanket was brought into improved electrical contact with the structural metal rod using two strips of 3M® 1181 TAPE. Each strip was contacted via its adhesive securely to the structural metal rod, and then secured via its adhesive over a long length along the blanket, on the side opposite the loop pile, in the direction of drape. The production line was run at three speeds: 100 fpm (Ex. 3), 200 fpm (Ex. 4) and 400 fpm (Ex. 5). A 3M® 718 Static Field Meter was used to measure the static field strength of the film at a location on the film roll being wound, but at a point beyond (in the direction of rotation) the area of contact between the blanket and the film roll being wound. At this location the field meter recorded a field strength of 0.4 KV/cm at all three speeds.

Examples 6-8

The trials of Examples 3-5 were repeated exactly, except the 3M® 1181 TAPE was not used. The blanket was thus less well contacted with machine ground. The production line was again run at three speeds: 100 fpm (Ex. 6), 200 fpm (Ex. 7) and 400 fpm (Ex. 8). A 3M® 718 Static Field Meter was used to measure the static field strength of the film at a location on the film roll being wound, but at a point beyond (in the direction of rotation) the area of contact between the blanket and the film roll being wound. At this location the field meter recorded a field strength of 2 KV/cm at 100 fpm (Ex. 6), 3 KV/cm at 200 fpm (Ex. 7) and 4 KV/cm at 400 fpm (Ex. 8).

Examples 9-11

The trials of Examples 3-5 were repeated exactly, except the static reduction blanket was not used. Thus, the line was run as it is normally run, so as to serve as a "control" experiment. The production line was again run at three speeds: 100 fpm (Ex. 9), 200 fpm (Ex. 10) and 400 fpm (Ex. 11). A 3M® 718 Static Field Meter was used to measure the static field strength of the film at a location on the film roll being wound, but at a point beyond (in the direction of rotation) the area of contact between the blanket and the film roll being wound. At this location the field meter recorded a field strength of 5 KV/cm at 100 fpm (Ex. 9), 8 KV/cm at 200 fpm (Ex. 10) and 20 KV/cm at 400 fpm (Ex. 11). Thus, at all speeds, without use of the static reduction blanket, static field strength for the roll being wound was much higher, and at 400 fpm, it was substantially as high as the field strength of the incoming film as measured in Ex. 2.

Example 12

In a home-built laboratory film transport testing apparatus, a polyethylene terephthalate (PET) web having a thickness of 2.0 mil (0.051 mm) was unwound and passed ½ inch beneath a 10 mil stainless steel DC corona wire electrode operating at 8 kV. The corona wire was positioned over a ground rubber coated idler roll, and the unwind speed was varied at levels up to 300 ft/min (91 m/min). Downstream from the corona charging station, a static reduction blanket made of the same fabric used in Examples 1-8 was configured to be in contact with the web as it passed over a roller. Electric fields were measured with a Monroe field meter, model #1019E, from Monroe Electronics, Lyndonville N.Y. The electrostatic field was measured after charging but before the blanket, with the meter positioned approximately 1 cm from the surface of the PET web, and physically distanced from any field attenuating rollers. The meter indicated a field strength of, or in excess of, 20 KV/cm, the meter's upper limit. The electrostatic field was also measured at a position past the blanket with the meter positioned approximately 1 cm from the surface of the PET web, and physically distanced from any field attenuating rollers. For all trials and at all speeds, the meter indicated a field strength of less than 1 KV/cm. This indicates a 20-fold or more reduction in field strength, which is an advantage of the invention. The deleterious effects electrostatic charge on the web (spark energy and electrostatic force upon the web) are proportional to the square of the field strength, so the blanket reduces these effects by 400-fold or more.

Example 13

Example 12 was repeated, but this time the area near the point where the film is nipped between a roller and the blanket was photographed with a CORONAFINDER™ UV camera, from Syntronics, LLC (Fredericksburg, Va.). The camera images showed that the corona, which is indicative of the charge jumping the air gap between charged film and blanket, begins well before the point of contact and continues all the way into the nip. When prior art static control devices, such as STATIC STRING™ (StopStatic.com, Marblehead, Mass.) are employed on a web line, it is imperative to space the conductive string a precise distance from the web in order for the corona, and hence the static dissipative effect, to appear. The corona does not appear at all if the conductive string is in contact with the web, and its effectiveness is diminished or eliminated entirely. Thus, another advantage of the present invention is the lack of any need to precisely position the static control device (in this case, the blanket). The static reduction blankets of the present invention work optimally even when actually in physical contact with the static-charged web.

Example 14

During routine operation of a production-scale polyester film-making line, violent static discharges, or "arcs" were observed to be happening regularly between the film web and a metal guard protecting a roller nip location despite the fact that the film web's closest contact to the nip guard was 8 inches. A static reduction blanket with enhanced connectivity to ground was prepared using the same materials employed in Example 1. However, rather than configuring the blanket so as to drape upon the film web near the roller/nip guard in question, the blanket was configured to drape off to the side of the web, and then translated horizontally and perpendicularly to the web path until the blanket made steady contact with the lateral edge of the travelling film web. Such slight contact eliminated the static discharge arcs.

Embodiments of the present invention include:

Item 1 is a static reduction blanket, comprising: a static reduction engagement cloth having an inner surface and an outer surface, the outer surface intended for contact with a moving web, the static reduction engagement cloth comprising: a resilient engagement surface; and electrically conductive fibers, wherein the electrically conductive fibers are disposed throughout the resilient engagement surface such that a portion of the electrically conductive fibers are proximate the outer surface.

Item 2 is the static reduction blanket of item 1, wherein the electrically conductive fibers are disposed in a first region of the resilient engagement surface and absent in a second adjacent region of the resilient engagement surface.

Item 3 is the static reduction blanket of item 2, wherein the first region and the second adjacent region form a continuous pattern across the resilient engagement surface.

Item 4 is the static reduction blanket of item 2, wherein the first region and the second adjacent region form a grid pattern across the resilient engagement surface.

Item 5 is the static reduction blanket of item 1, wherein the electrically conductive fibers comprise metal coated fibers, metal fibers, alloy fibers, carbon fibers, or a combination thereof.

Item 6 is the static reduction blanket of item 1, wherein the electrically conductive fibers have a length that includes kinks, bumps, ends or a combination thereof, that form pointed conductive regions.

Item 7 is the static reduction blanket of item 1, wherein the resilient engagement surface is a knit fabric comprising a base layer having first and second faces and a resilient looped pile protruding from the first face.

Item 8 is the static reduction blanket of item 7, wherein the base layer comprises a woven base layer, a knitted base layer, a non-woven base layer, or a combination thereof.

Item 9 is the static reduction blanket of item 7, wherein the electrically conductive fibers are disposed in the resilient looped pile.

Item 10 is the static reduction blanket of item 1, wherein the static reduction engagement cloth comprises a rectangle shape.

Item 11 is the static reduction blanket of item 7, wherein the resilient looped pile comprises a fibrous material selected from poly(tetrafluoroethylene), aramid, polyester, polypropylene, polyethylene, nylon, wool, bamboo, cotton, or a combination thereof.

Item 12 is the static reduction blanket of item 1, wherein the resilient looped pile fabric comprises a fiber having a size ranging from about 35 denier to about 400 denier.

Item 13 is the static reduction blanket of item 1, wherein the resilient looped pile fabric comprises loops having a height from about 0.25 mm to about 5 mm.

Item 14 is the static reduction blanket of item 1, wherein the electrically conductive fibers comprise a fiber having a size ranging from about 3 microns to about 20 microns.

Item 15 is the static reduction blanket of item 1, wherein the electrically conductive fibers comprise a plurality of ends, and are intertwined in electrical contact throughout the resilient engagement surface.

Item 16 is an apparatus for reducing static on a web, comprising: a static reduction blanket according to item 1; and an electrically conductive member in electrical contact with the static reduction blanket and in electrical contact with an electrical ground, wherein a first major surface of a web material contacts the outer surface of the static reduction blanket.

Item 17 is the apparatus of item 16, further comprising: a means for enhancing electrical contact between the electrically conductive member and the static reduction blanket.

Item 18 is the apparatus of item 17, wherein the means for enhancing electrical contact comprises a conductive tape.

Item 19 is the apparatus of item 18, wherein the conductive tape comprises a conductive adhesive.

Item 20 is the apparatus of item 17, wherein the means for enhancing electrical contact comprises a conductive hook and loop fastener.

Item 21 is the apparatus of item 16, further comprising a corona discharge generator positioned adjacent the first major surface of the web material, upweb from the static reduction blanket.

Item 22 is the apparatus of item 21, further comprising a second corona discharge generator positioned adjacent the second major surface of the web material, upweb from the static reduction blanket.

Item 23 is the apparatus of item 16, wherein the first major surface of a web material contacts the outer surface of the static reduction blanket while within a winder or an unwind station.

Item 24 is a method for reducing static on a web, comprising: providing an apparatus according to item 16 or item 17; conveying the web material in a downweb direction; and contacting the moving web material with the resilient engagement surface of the static reduction blanket, thereby removing static charge from the web material and discharging the static charge to the electrical ground.

Item 25 is the method of item 24, further comprising: charging the web material with a corona discharge prior to contacting the moving web material with the resilient engagement surface.

Item 26 is a static reduction cloth, comprising: a static reduction engagement cloth having an inner surface and an outer surface, the outer surface intended for contact with a shaped part, the static reduction engagement cloth comprising: a resilient engagement surface; and electrically conductive fibers, wherein the electrically conductive fibers are disposed throughout the resilient engagement surface such that a portion of the electrically conductive fibers are proximate the outer surface.

Item 27 is an apparatus for reducing static on a shaped part, comprising: a static reduction cloth according to item 26; and an electrically conductive member in electrical contact with the static reduction cloth and in electrical contact with an electrical ground.

Item 28 is a method for reducing static on a shaped part, comprising: providing an apparatus according to item 27; providing a shaped part; and rubbing the shaped part with the resilient engagement surface of the static reduction cloth, thereby removing static charge from the web material and discharging the static charge to the electrical ground.

Unless otherwise indicated, all numbers expressing feature sizes, amounts, and physical properties used in the specification and claims are to be understood as being modified by the term "about". Accordingly, unless indicated to the contrary, the numerical parameters set forth in the foregoing specification and attached claims are approximations that can vary depending upon the desired properties sought to be obtained by those skilled in the art utilizing the teachings disclosed herein.

All references and publications cited herein are expressly incorporated herein by reference in their entirety into this disclosure, except to the extent they may directly contradict this disclosure. Although specific embodiments have been illustrated and described herein, it will be appreciated by those of ordinary skill in the art that a variety of alternate and/or equivalent implementations can be substituted for the specific embodiments shown and described without departing from the scope of the present invention. This application is intended to cover any adaptations or variations of the specific embodiments discussed herein. Therefore, it is intended that this disclosure be limited only by the claims and the equivalents thereof.

What is claimed is:

1. A static reduction blanket comprising:

a resilient static reduction engagement cloth in sheet form having an inner surface and an outer surface, the resilient static reduction engagement cloth being arranged to hang over a moving web such that the resilient static reduction engagement cloth makes brushing or wiping contact with the web;

the resilient static reduction engagement cloth comprising electrically conductive fibers disposed throughout the resilient static reduction engagement cloth such that a portion of the electrically conductive fibers is proximate the outer surface of the resilient static reduction engagement cloth and a portion of the electrically conductive fibers form looped piles extending outwardly from the outer surface.

2. The static reduction blanket of claim 1 wherein the looped piles of electrically conductive fibers are disposed in a first region of the outer surface and absent in a second adjacent region of the outer surface.

3. The static reduction blanket of claim 2 wherein the first region and the second adjacent region form a continuous pattern across the outer surface made up of one or more first regions and one or more second regions.

4. The static reduction blanket of claim 2 wherein the first region and the second adjacent region form a grid pattern across the outer surface.

5. The static reduction blanket of claim 1 wherein the electrically conductive fibers comprise metal coated fibers, metal fibers, alloy fibers, carbon fibers, or a combination thereof.

6. The static reduction blanket of claim 1 wherein the electrically conductive fibers have a length that includes kinks, bumps, ends or a combination thereof, that form pointed conductive regions in the looped piles.

7. The static reduction blanket of claim 1 wherein the static reduction engagement cloth is a knit cloth comprising a base layer having first and second faces and the resilient looped pile protruding from the first face of the base layer.

8. The static reduction blanket of claim 7 wherein the base layer comprises a woven base layer, a knitted base layer, a non-woven base layer, or a combination thereof.

9. The static reduction blanket of claim 1 wherein the static reduction engagement cloth is rectangular in shape.

10. The static reduction blanket of claim 7 wherein the resilient looped pile comprises a fibrous material selected from poly(tetrafluoroethylene), aramid, polyester, polypropylene, polyethylene, nylon, wool, bamboo, cotton, or a combination thereof.

11. The static reduction blanket of claim 1 wherein the resilient looped pile comprises a fiber having a size ranging from 35 denier to 400 denier.

12. The static reduction blanket of claim 1 wherein the resilient looped pile comprises loops having a height from 0.25 mm to 5 mm.

13. The static reduction blanket of claim 1 wherein the electrically conductive fibers comprise a fiber having a size ranging from 3 microns to 20 microns.

14. The static reduction blanket of claim 1 wherein the electrically conductive fibers comprise a plurality of ends, and are intertwined in electrical contact throughout the outer surface.

15. An apparatus for reducing static on a web comprising:

the static reduction blanket of claim 1; and an electrically conductive member in electrical contact with the static reduction blanket and with an electrical ground, wherein a first major surface of the web material contacts the outer surface of the static reduction blanket.

16. The apparatus of claim 15 further comprising a means for enhancing electrical contact between the electrically conductive member and the static reduction blanket.

17. The apparatus of claim 16 wherein the means for enhancing electrical contact comprises a conductive tape.

18. The apparatus of claim 17 wherein the conductive tape comprises a conductive adhesive.

19. The apparatus of claim 16 wherein the means for enhancing electrical contact comprises a conductive hook and loop fastener.

20. The apparatus of claim 15 further comprising a corona discharge generator positioned adjacent the first major surface of the web material, upweb from the static reduction blanket.

21. The apparatus of claim 20 further comprising a second corona discharge generator positioned adjacent the second major surface of the web material, upweb from the static reduction blanket.

22. The apparatus of claim 15 wherein the first major surface of the web material contacts the outer surface of the static reduction blanket while within a winder or an unwind section.

23. A method for reducing static on a web comprising:

providing the apparatus of claim 15;

conveying the web material in a downweb direction; and contacting the moving web material with the outer surface of the static reduction blanket, thereby removing static charge from the web material and discharging the static charge to the electrical ground.

24. The method of claim 23 further comprising:

charging the web material with a corona discharge prior to contacting the moving web material with the outer surface.

25. A static reduction cloth comprising:

a resilient static reduction engagement cloth in sheet form having an inner surface and an outer surface, the resilient static reduction engagement cloth comprising electrically conductive fibers disposed throughout the resilient static reduction engagement cloth such that a portion of the electrically conductive fibers are proximate the outer surface and a portion of the electrically conductive fibers form electrically conductive looped piles extending outwardly from the outer surface, the electrically conductive looped piles being arranged in an electrically conductive pattern across the outer surface, the electrically conductive pattern comprising a grid pattern, a diamond pattern, or a checkerboard pattern.

26. An apparatus for reducing static on a shaped part, comprising:

the static reduction cloth of claim 25; and an electrically conductive member in electrical contact with the static reduction cloth and in electrical contact with an electrical ground.

27. A method for reducing static on a shaped part, comprising:

providing the apparatus of claim 26;

providing the shaped part; and rubbing the shaped part with the outer surface of the static reduction cloth, thereby removing the static charge from the web material and discharging the static charge to the electrical ground.

28. The static reduction cloth of claim 25, wherein the electrically conductive pattern comprises a grid of electrically conductive looped piles.

* * * * *